United States Patent [19]

Marciniak et al.

[11] Patent Number: 4,821,597

[45] Date of Patent: Apr. 18, 1989

[54] OPERATING CRANK FOR VEHICLES

[75] Inventors: George Z. Marciniak, St. Clair Shores; William M. Selkirk, Burton, both of Mich.

[73] Assignee: General Motors Corporation, Detroit, Mich.

[21] Appl. No.: 378,641

[22] Filed: May 17, 1982

[51] Int. Cl.[4] ..... G05G 1/00

[52] U.S. Cl. ..... 74/545; 74/557; 16/121; 403/289; 403/165

[58] Field of Search ..... 74/545, 557; 16/121, 16/118; 403/289 X, 165 X; 249/122, 121, 297

[56] References Cited

U.S. PATENT DOCUMENTS

| | | | |
|---|---|---|---|
| 1,517,524 | 12/1924 | Arras et al. | 264/297.9 |
| 2,978,927 | 4/1961 | Blanton | 16/121 |
| 3,004,238 | 10/1961 | Damon | 74/501 P |
| 3,071,023 | 1/1963 | Herr et al. | 74/545 |
| 4,052,768 | 10/1977 | Yamazaki et al. | 74/545 |

FOREIGN PATENT DOCUMENTS

| | | | |
|---|---|---|---|
| 2264511 | 1/1974 | Fed. Rep. of Germany | 74/545 |
| 2817127 | 11/1978 | Fed. Rep. of Germany | 74/545 |
| 1336267 | 7/1963 | France | 403/289 |
| 2046192 | 11/1980 | United Kingdom | 16/121 |

*Primary Examiner*—Gary L. Smith
*Assistant Examiner*—Rodney M. Lindsey
*Attorney, Agent, or Firm*—Patrick M. Griffin

[57] ABSTRACT

An operating crank for a window regulator mechanism includes a one piece molded handle having a visible side and a non-visible side when mounted at one end to a driven mechanism. A knob is rotatably attched to the visible side of the other end of the handle by an attachment located generally in the area where the knob is gripped by an operator. The attachment includes a series of molded ribs on a shank which extends axially from the visible side of the handle and which rotate within a groove inside the knob. The knob retention ribs extend radially of the shank and are molded integrally to the shank by means of a die insert receivable through access slots defined through the knob end of the handle from the non-visible side of the handle, giving access to the coplanar bottom surfaces of the knob retention ribs. The retention ribs may thereby be molded without leaving a visible parting line on the visible side of the handle.

2 Claims, 1 Drawing Sheet

OPERATING CRANK FOR VEHICLES

BACKGROUND OF THE INVENTION

This invention relates to operating cranks for vehicles and more particularly to such a crank having a molded plastic one piece handle and rotatable knob.

Operating cranks for vehicles such as window regulator cranks, generally include a handle having a first end secured to a driven device and a second or knob end to which a knob is rotatably attached. When mounted to the vehicle, one side of the handle is visible while the other side is non-visible and faces the body. It is desirable that the handle be easily molded in a conventional male-female mold with fixed mold inserts and that no parting lines be visible on the one side of the handle. It is also desirable that the knob be easily assembled to the handle and that it rotate relative to the handle without excessive wobble or friction.

Various operating cranks for vehicles exist in the prior art. Herr et al U.S. Pat. No. 3,071,023 shows several embodiments of crank arms of non-plastic construction and various types of rotatable knobs which are secured to an end of the handle by different types of separate pin arrangements. Blanton U.S. Pat. No. 2,978,927 and Yamaziki et al U.S. Pat. No. 4,052,768 both show a metal handle and a plastic knob secured to on end of the handle.

SUMMARY OF THE INVENTION

The operating crank of this invention includes a molded plastic, one piece handle which may be molded easily in a conventional mold with fixed mold inserts without leaving a parting line on the visible, outer side of the handle. The knob end of the handle includes a cylindrical shank extending from the visible side of the handle with a series of integrally molded knob retention ribs thereon which are spaced from the visible side of the handle. The ribs ride within a matching annular groove inside a molded one piece plastic knob. Since the annular groove is located generally planar with the area of the knob gripped by an operator, the knob will rotate relative to the handle without excessive wobble.

In the preferred embodiment the knob end of the handle includes a boss on the visible side from which the cylindrical shank extends axially outwardly. The knob retention ribs extend radially outwardly from the shank, lie partially over the boss, and are axially spaced therefrom. In order that the ribs may be integrally molded to the shank without leaving a visible parting line on the visible side of the handle, a plurality of access slots, one respective the under-surface of each knob retention rib, extend from the non-visible side of the handle through the boss and partially through the shank as far as the underside of the ribs. The slots result from a fixed die insert which forms the under-surface of the ribs with the cylindrical shank without leaving a parting line visible on the visible side of the handle and allows the handle to be withdrawn from the mold.

It is therefore an object of this invention to provide an operating crank for vehicles which includes a molded one piece handle and a knob rotatably attached to an integral portion of the handle outwardly of the outer or visible side thereof. It is another object to provide such a crank wherein no parting lines are visible on the visible or outer side of the handle. It is a further object to provide such a crank wherein the integral portion of the handle includes a shank extending from one end of the handle on the visible side thereof and having a series of knob retention ribs located outwardly of the visible side of the handle and being molded integrally with the handle by means of a die insert which projects through the handle from the non-visible side thereof to the visible side, with the material of the shank intermediate the ribs joining the shank to the handle by strengthened ribs.

BRIEF DESCRIPTION OF THE DRAWINGS

These and other objects of the invention will be readily apparent from the following specification and drawings wherein.

DESCRIPTION OF THE PREFERRED EMBODIMENT

Figure 1:
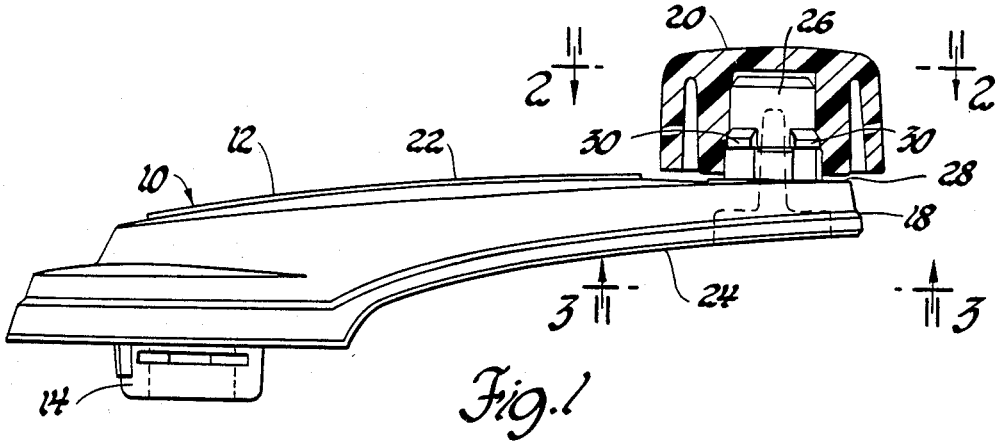
FIG. 1 is a side elevational view of a crank according to this invention with the knob partially broken away.
Figure 2:
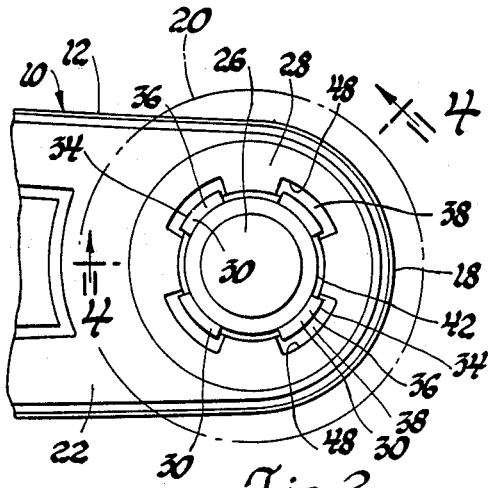
FIG. 2 is a plan view taken on line 2—2.

Referring now to FIG. 1, an operating crank designated generally 10 includes a handle 12 having a cylindrical extension 14 at a first end thereof for conventionally securing the crank to a driven mechanism, such as a window regulator drive mechanism. The second or knob end 18 of handle 12 is adapted to be rotatably attached to a knob 20 as will be further described. When mounted to the driven mechanism, handle 12 as a visible outer side 22 and non-visible inner side 24 which faces the door or other panel of the vehicle.

Figure 4:
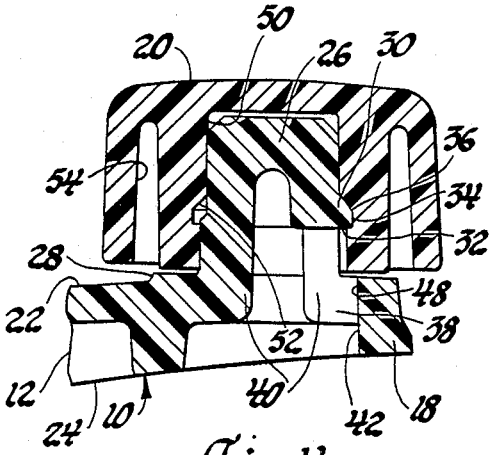
FIG. 4 is an enlarged sectional view taken along the line 4—4 of FIG. 2.
Figure 5:
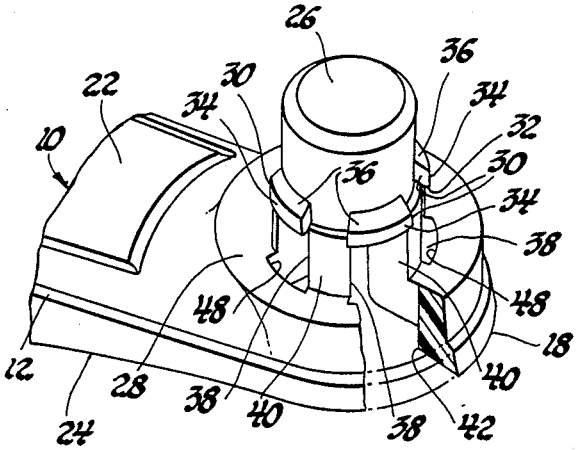
FIG. 5 is a partially broken away perspective view.

As shown in FIGS. 1 and 5, a cylindrical shank 26 extends outwardly from a cylindrical boss 28 at the knob end 18 of the handle 12. Equally spaced around the periphery of shank 26 are four radially extending knob retention ribs 30 which are axially spaced from boss 28. Each rib 30, as shown in FIGS. 4 and 5, includes a planar under-surface or lower wall 32, a cylindrical outer wall 34, and a conical upper wall 36. The walls 32 lie in a common radial plane of shank 26 and partially overlie the outer wall of boss 28. It is desirable to integrally mold ribs 30 with handle 12 and insure that no visible parting line results from such molding on the visible outer side 22 of the handle.

Figure 3:
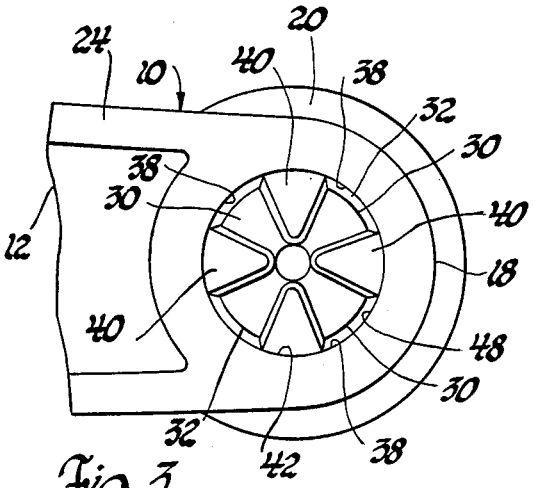
FIG. 3 is a plan view taken on line 3—3.

Four access slots 38 extend axially through boss 28 and shank 26 to the walls 32 of the ribs 30 and define four structural ribs 40 of generally triangular cross-section as shown in FIG. 3. The upper ends of the ribs 40 are joined to the lower wall of shank 26 coplanar with walls 32. The lower ends of the ribs terminate within boss and are joined by a circular wall 42 of the boss.

As best shown in FIG. 3, the lower portions 48 of slots 38 through the boss 28 have a cross-sectional area which is slightly greater than the cross-sectional area of the portions of the under-surfaces 32 of ribs 30 which overlie the outer wall of boss 28.

During the molding of the handle 12 in a conventional male-female mold, the slots 38 result from a die insert projecting from the non-visible inner side 24 of the handle in order that the parting line between the halves of the mold can be located at the outer edge of the handle 12 between outer side 22 and inner side 24 and yet the ribs 30 can be molded integrally with the handle.

It should be understood that although four ribs 30 and slots 38 are shown, the number of such ribs and slots can vary. Likewise, the dimensions of the slots 38 will vary with the desired dimensions of the under-surfaces 32 of ribs 30, and could be only as large as the cross-sectional area of rib under-surface 32, the minimum necessary to mold ribs 30. The structure ribs 40 need not be of triangular cross-section but should be of sufficient cross-section to integrally connect the shank 26 to the boss 28 without cracking or separation during the life of the crank 10.

Referring now to FIG. 4, knob 20 includes a central cylindrical bore 50 which has a diameter and depth substantially equal to the diameter and length of shank 26. The inside of bore 50 includes an annular groove 52 which has a cross-section substantially the same as the cross-section of knob retention ribs 30. Knob 20 further includes a continuous, circumferentially extending annular slot 54. Knob 20 is assembled to shank 26 by forcibly inserting the ribs 30 into bore 50 until the ribs snap into groove 52. Slot 54 allows the inside wall containing bore 50 to slightly flex radially outwardly during such assembly. Knob 20 rotates freely on shak 26 as knob retention ribs 30 move within annular groove 52. Since the attachment of knob 20 is on the outer side 22 of handle 12 and in the general area where knob 20 is gripped by an operator, the lever arm will be very short and the potential wobble of knob 20 will be at a minimum.

The embodiments of the invention in which an exclusive property or privilege is claimed are defined as follows:

1. An operating crank for a window regulator drive mechanism or the like, comprising, a one-piece, integrally molded handle having a first end adapted for attachment to the drive mechanism and a second end adapted for attachment to a knob, the handle including an outer side and an inner side, an axial shank extending from the outer side of the second end, a plurality of circumferentially spaced knob retention ribs extending radially outwardly from the shank in axially spaced relationship to the outer side of the second end, the second end of the handle including a plurality of access slots equal in number to the ribs and extending from the inner side of the second end of the handle through the outer side and along the shank to the knob retention ribs, each slot being of sufficient size to allow unencumbered access for a mold insert receivable therein from the inner side of the handle, whereby the shank and the knob retention ribs may be integrally molded in a mold which parts between the outer and inner sides of the handle, the material of the shank intermediate the slots providing an integral connection of the shank to the second end of the handle, and a knob mounted on the knob retention ribs.

2. An operating crank for a window regulator drive mechanism or the like, comprising, a one-piece, integrally molded handle having a first end adapted for attachment to the drive mechanism and a second end adapted for attachment to a knob, the handle having an outer side and an inner side, a cylindrical shank extending from the outer side of the second end, a plurality of knob retention ribs extending radially from the shank and axially spaced from the outer side, each rib having an under-surface that lies partially over the second end, the second end of the handle including a plurality of access slots equal in number to the ribs and extending from the inner side of the handle along the shank to the under-surface of the knob retention ribs, each access slot having a cross-sectional area substantially coextensive with the under-surface of its respective knob retention rib and adapted thereby to provide unencumbered access for a mold insert receivable therein from the inner side so that the handle will not have a parting line visible on its outer side after the handle has been integrally molded.

* * * * *